United States Patent [19]

Kolb

[11] Patent Number: 4,545,395

[45] Date of Patent: Oct. 8, 1985

[54] PAINT ROLLER APPARATUS WITH INHERENT CLEANING CAPABILITY

[76] Inventor: William F. Kolb, 2844 Castle Harbour Pl., Ontario, Calif. 91761

[21] Appl. No.: 552,421

[22] Filed: Nov. 16, 1983

[51] Int. Cl.[4] ..... B08B 3/04

[52] U.S. Cl. ..... 134/115 R; 15/230.11; 134/140; 134/149; 403/3

[58] Field of Search ..... 134/33, 59, 115 R, 137, 134/138, 140, 141, 149, 152, 153, 157, 166 R, 170; 68/213; 15/230.11; 29/110.5; 403/3; 81/58.1

[56] References Cited

U.S. PATENT DOCUMENTS

| | | | |
|---|---|---|---|
| 2,542,491 | 2/1951 | Engel | 68/213 X |
| 2,913,752 | 11/1959 | Boyles | 15/230.11 |
| 3,436,264 | 4/1969 | Allen | 134/33 |
| 3,575,069 | 4/1971 | White | 81/58.1 |
| 4,212,336 | 7/1980 | Smith | 81/58.1 X |
| 4,263,055 | 4/1981 | Permar | 134/33 |

*Primary Examiner*—Philip R. Coe

[57] ABSTRACT

The Paint Roller Apparatus with Inherent Cleaning Capability constitutes a roller type apparatus upon which can be mounted a conventional paint roller pad, and which includes a means for coupling rotary energy to the roller part of the Apparatus and a means of swiveling the handle of the said apparatus and locking the said handle into either of two positions: one position for use of the apparatus as a paint applicator; the other position for use of the apparatus to clean the paint roller pad by applying the said rotary energy.

5 Claims, 11 Drawing Figures

PAINT ROLLER APPARATUS WITH INHERENT CLEANING CAPABILITY

FIELD OF INVENTION

This invention relates to paint rollers and specifically to structural variations to prior art that allow simple, efficient, convenient cleaning of the paint roller pad.

PRIOR ART

Heretofore paint roller pads were cleaned by two basic techniques. These are herein called: Simple Cleaning, and Rotary Cleaning.

Simple Cleaning:

Simple Cleaning is herein defined as cleaning without any additional apparatus other than paint solvent (water, or petroleum-base solvent) and a vessel for same. Simple cleaning, to my knowledge, is the most commonly used technique for cleaning paint roller pads.

By the Simple Cleaning method, paint roller pads, after use, are rolled in a liquid bath consisting of petroleum-base solvent (to clean oil-base paint) or water (to clean water-base paint). This is done many times, tediously, repeatedly changing the bath liquid. Finally, the paint roller pad is wiped with a rag in an attempt to remove any remaining paint residue from it.

Depending on how diligently the Simple Cleaning method is applied, a certain amount of paint residue usually remains on the paint roller pad. This is especially true when oil-base paint is used for the paint job, and an emphasis is placed on concerving the paint solvent. Usually, after several uses, the paint roller pad becomes unuseable due to accumulated residue, and it must be discarded.

Rotary Cleaning:

Rotary Cleaning is herein defined as any method of cleaning that uses the forces generated by rotary motion of the object being cleaned as the cleaning principles.

Several cleaning devices that embody previously patented inventions utilize rotary motion to expedite cleaning paint roller pads. Typically, the cleaning device, or a part thereof, is inserted into a drill-motor chuck, or the like. The said motor supplies the required rotary power. To use these devices, the paint roller pad is removed from the paint roller apparatus, and mounted on the cleaning device. The mounted paint roller pad is then immersed in a liquid bath contained in a suitable vessel. Rotary power is applied, and the said paint roller pad is scrubbed by the rotary action while centrifugal force drives the paint residue outward to disperse into the liquid.

Problems With Prior Art:

Simple Cleaning of paint roller pads, although, to my knowledge, presently the most commonly used method, is tedious, messy, and inefficient; and can be substantially wasteful of petroleum-base paint solvent.

Rotary Cleaning of paint roller pads using prior art devices, although speedy and efficient, has a degree of awkwardness and messiness characteristic of the need to manually handle the paint-laden paint roller pad when removing it from the paint roller apparatus and mounting it on the cleaning apparatus.

Market Analysis of Prior Art:

The tediousness, messiness, inefficiency, wastefulness, and awkwardness of cleaning paint roller pads using prior art techniques has given rise to the manufacture and distribution of cheap "throw-away" paint roller pads. The cheapness of these paint roller pads, while enabling them to be economically thrown away, and thereby obviating their need for cleaning, necessarily reduced their quality. This reduction in the quality resulted in poorer quality, and more time consuming, paint jobs.

Virtue of My Invention Over Prior Art:

My invention also utilizes the forces generated by rotary motion as the cleaning principles; but, unlike the devices of prior art, I have incorporated a mechanism into the paint roller apparatus itself that expedites the applicaton of rotary power to the paint roller pad without the need for removing the paint roller pad for cleaning.

I believe, because of the structural innovation, which is subsequently described herein, my invention overcomes all of the drawbacks of prior art described under the above heading: Problems With Prior Art. My invention, by prolonging the useful life of paint roller pads, also satisfies a market need that will make it economically feasible for the production of higher quality paint roller pads.

OBJECT OF THE INVENTION

The object of the invention is to provide a means for using a paint roller pad to apply paint to a suitable surface, that means including a means for speedily, efficiently, and conveniently cleaning that paint roller pad.

GENERAL DESCRIPTION OF THE INVENTION

The invention consists of paint roller apparatus upon which can be mounted a paint roller pad, said apparatus having a handle that can conveniently attain, and lock in two positions: one for using the apparatus for painting, and the other for using the apparatus to clean the paint roller pad. The invention includes a detachable drive shaft one end of which inserts into the chuck of a conventional electric drill motor, or the like. The other end of the drive shaft inserts into the end of the roller shaft of the apparatus. The said drill motor provides rotary power for the cleaning operation.

When in position for painting, the handle of the invented device is locked conventionally adjacent to, but at a right angle to the axis of the roller of the apparatus. When in position for cleaning the paint roller pad, the handle is locked similarly at a right angle to the said roller axis, but offset away from the roller pad so as not to interfere with the cleaning operation.

To expedite attaining the two said positions, the handle of the invented device is locked into a coupling apparatus that allows the handle to swivel into the two positions. The coupling apparatus includes a locking device that accomplishes locking the handle into the coupling while also locking the handle into either of the two said positions.

DRAWINGS

The figures included with, and constituting a part of this document, illustrate overall and detailed views of an apparatus that embodies the invention idea.

FIG. 2 includes two items of simple hardware: a flat waster and a retaining ring.

Figures 1, 2, 3, 4, 5, 6, 7, 8:
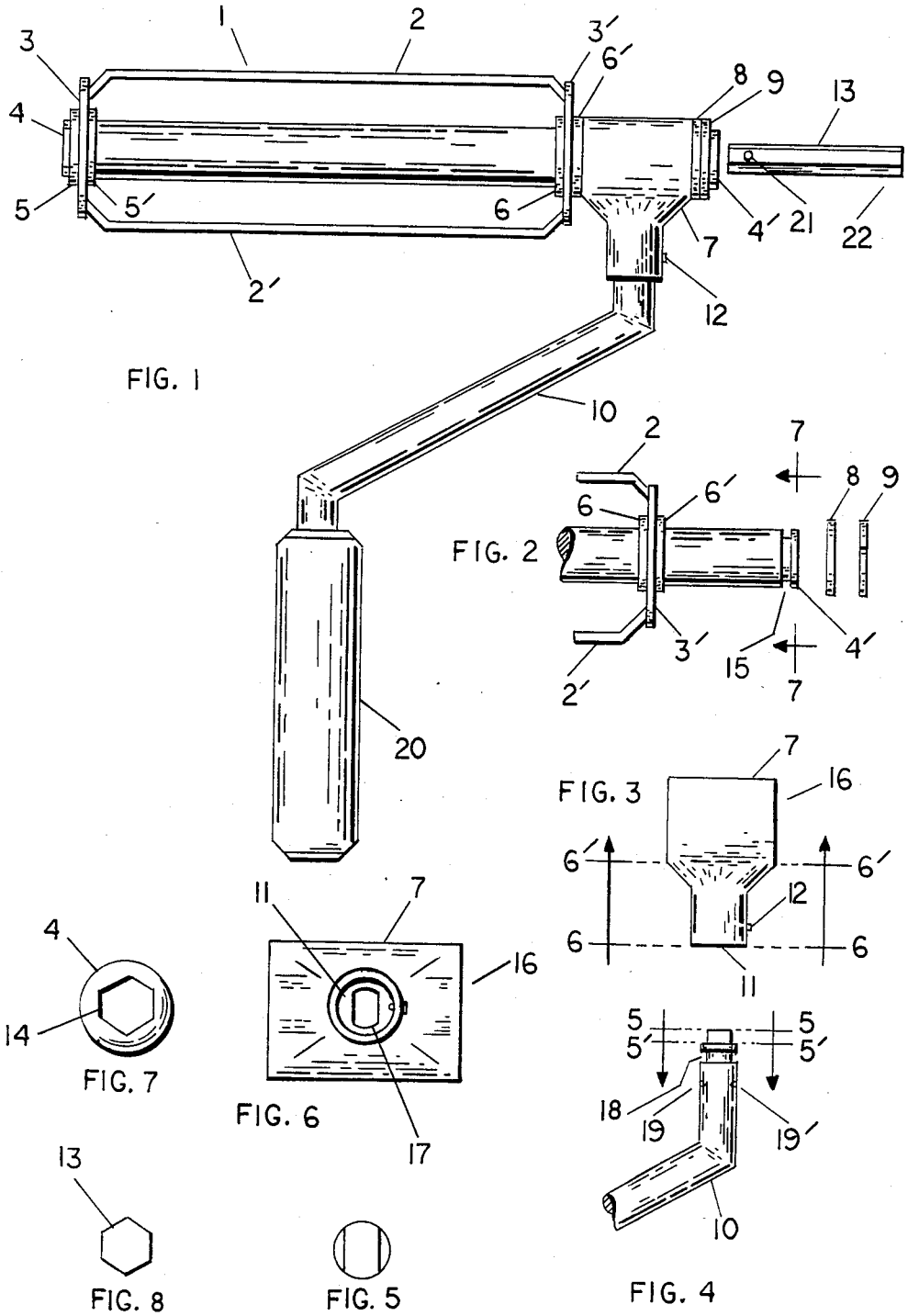
FIG. 1 is a side view of the entire paint roller apparatus, showing the handle in position for painting, and showing the detachable drive shaft.
FIG. 2 is a side view of that part of the roller shaft that inserts into the coupling apparatus, located under the area designated A in FIG. 1.
FIG. 3 is a side view of the coupling apparatus also included under the area designated A in FIG. 1. The shaft end illustrated in FIG. 2 inserts into this coupling apparatus.
FIG. 4 is a partial side view of the end of the handle that inserts into the coupling apparatus showing its end configuration that enables it be locked in place.
FIG. 5 is an end view of the handle encompassed by the lines disignated 5,5 and 5',5' in FIG. 4.

FIG. 6 is a view of the coupling apparatus represented by the area encompassed by the lines designated 6,6 and 6',6' in FIG. 3. FIG. 6 shows the shape of the hole located on the line designated 6',6', which shape matches the end view of the handle illustrated in FIG. 5.

FIG. 7 is an end view of the roller shaft designated by the line 7,7 in FIG. 2.

FIG. 8 is an end view of the detachable drive shaft illustrated in FIG. 1.

Figure 9:
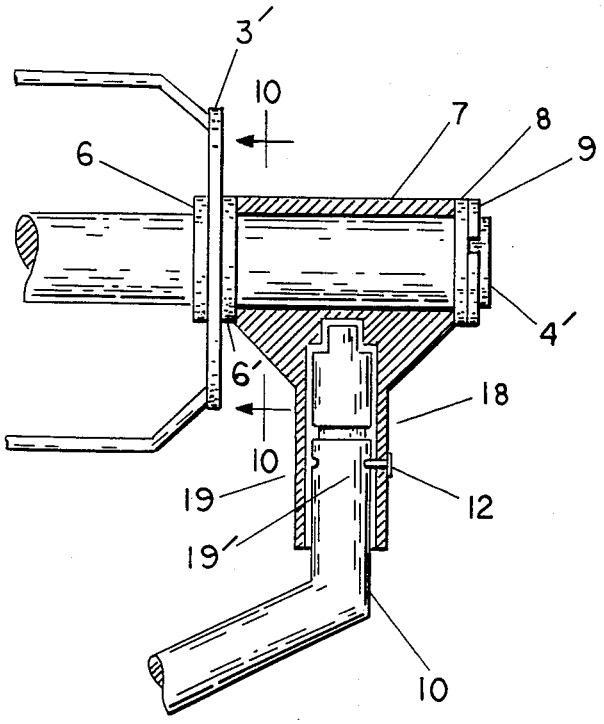

FIG. 9 is a detail, cutaway, side view of the coupling apparatus assembled to the roller shaft and handle, showing how the roller shaft inserts into its bearing in the coupling and is held in place by the flat washer and the retaining ring; and how the handle end inserts into its mating opening in the coupling and locks in place by means of a spring-loaded catch.

Figure 10:
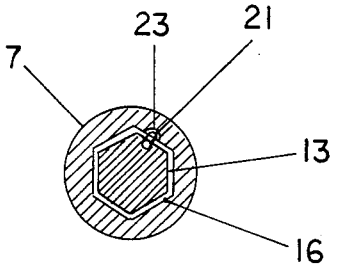

FIG. 10 is a cutaway partial section of the assembled apparatus designated by line 10,10 in FIG. 9, showing how a spring-loaded catch on the drive shaft retains the drive shaft when it is fully inserted into the roller shaft.

Figure 11:
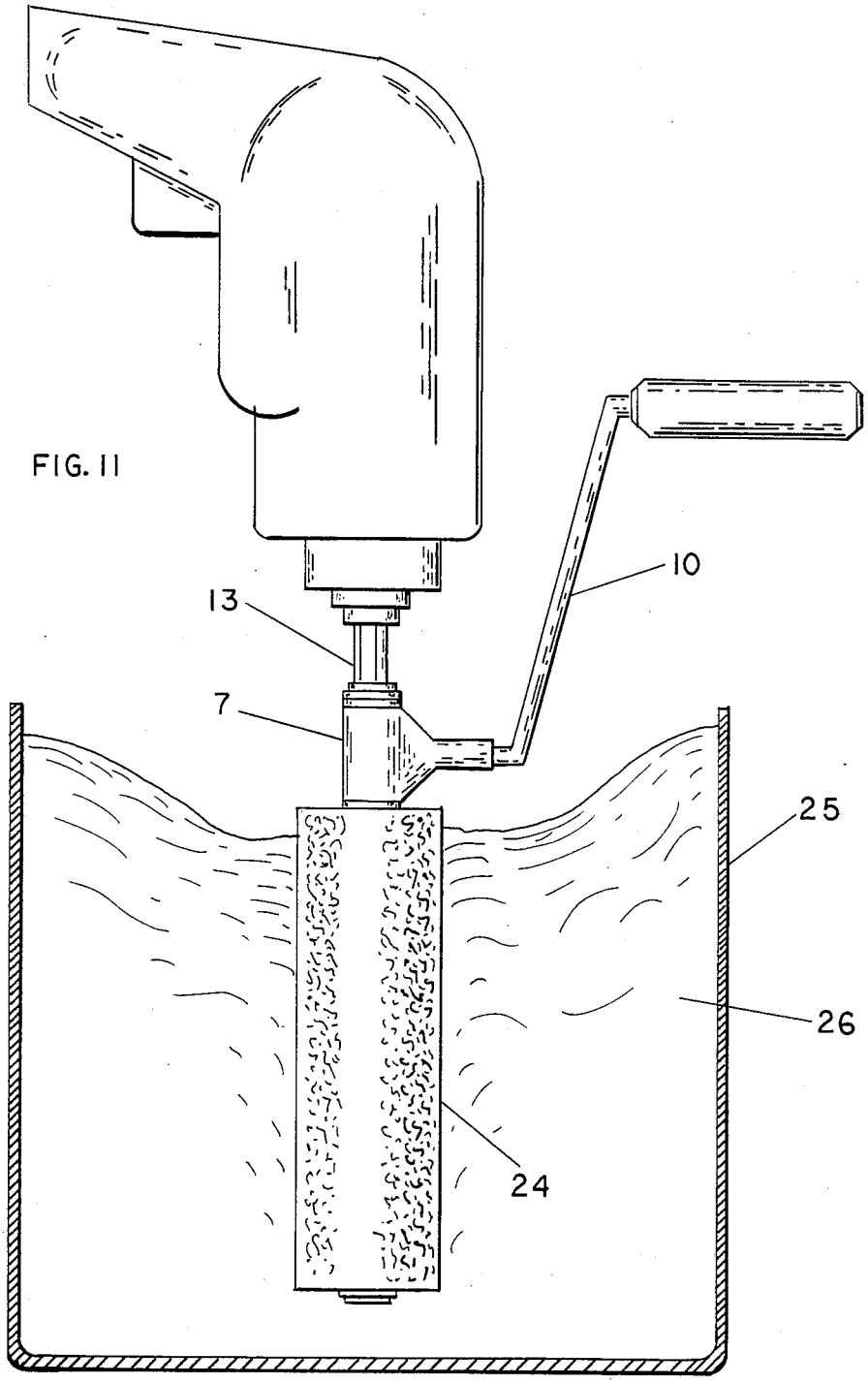

FIG. 11 is a side view of the apparatus completely assembled, with a paint roller pad mounted, and with the handle in position for cleaning the said paint roller pad. The apparatus is shown being driven by an electric drill motor. The cleaning liquid is shown as it appears while the paint roller pad is actually rotating. The significance of this liquid surface configuration is explained in the section of this document titled: Analysis of Cleaning Action.

DETAIL DESCRIPTION OF THE INVENTION

Introduction

The apparatus that embodies the invention is illustrated in its entirety in FIG. 1, in pertinent detail in FIG. 2 through FIG. 10 and in action as a paint roller pad cleaner in FIG. 11. The following description refers to these figures.

Description:

The apparatus consists of four major components: a Roller Assembly 1, a Coupling 7, a Handle 10, and a Drive Shaft 13.

Ref. FIG. 1: The Roller Assembly 1 consists of a framework 2,2' of three or more rungs mounted on two disks 3,3' which are mounted on a hollow shaft 4,4'. The two disks are held rigidly to the hollow shaft 4,4' by four collars 5,5',6,6'. One end of the hollow shaft 4,4' extends beyond the framework 2,2', and inserts into a bearing 16 in FIG. 3 in the Coupling 7. The Roller Assembly 1 is secured to the Coupling 7 by means of a flat washer 8 and retaining ring 9. The Handle 10 inserts into an opening 11 in FIG. 3 in the Coupling 7, and is held in place by a spring-loaded catch 12.

Drive Shaft 13 inserts into the end 4' of the hollow shaft 4,4' of the Roller Assembly 1, and is held in place by a spring-loaded catch 21, as illustrated in FIG. 10 The Drive Shaft 13 and the inner surface 14 in FIG. 7 of the hollow shaft 4,4' of the Roller Assembly 1 are both hexagonal in shape, as illustrated in FIG. 7 and FIG. 8.

Ref. FIG. 2: The end of the hollow shaft 4,4' of the Roller Assembly 1 has a groove 15 which is correctly sized to accept the retaining ring 9. The groove 15 is positioned so that when the hollow shaft 4,4' is inserted into the Coupling 7, there is sufficient clearance to place the flat washer 8 on the hollow shaft 4,4' before installing the retaining ring 9.

Ref. FIG. 3: The coupling 7 has the basic shape of a "T" with a hole 16 through the crossbar section from end to end, the said hole forming a bearing in which the hollow shaft 4,4' of the Roller Assembly 1 can rotate when assembled to the Coupling 7. The vertical part of the "T" structure has a hole 11 that recesses into that vertical part of the "T" structure to a point just below the hole in the crossbar, and is correctly sized to accept the end of the Handle 10 illustrated in FIG. 4. Within the hole of the vertical part of the "T" structure, there is a recess 17 in FIG. 6, having the same shape as the end of the Handle 10 illustrated in FIG. 5.

Ref. FIG. 9: When the Apparatus is completely assembled, the Roller Assembly 1 and Handle 10 fit into the Coupling 7. The Handle 10 has a groove 18 and two shallow holes 19,19' which are spaced correctly to accept the spring-loaded catch 12. The Coupling 7 has a hole 20 positioned at the "top" center of the "T" crossbar appropriate for receiving lubricating oil or grease.

ASSEMBLING THE APPARATUS

The Roller Assembly 1 and the Handle 10 simply inserts into the Coupling 7 as illustrated in FIG. 1 and FIG. 9. The washer 8 and retaining ring 9 then slide over the end of the hollow shaft 4,4'.

Assembly Instructions:

1. Insert the end 4' of the hollow shaft 4,4' of the Roller Assembly 1 into the bearing hole 16 designated in FIG. 3 and FIG. 6.

2. Slide the washer 8 and the retaining ring 9 over the end 4' of the hollow shaft 4,4', and seat the retaining ring into the groove 15 illustrated in FIG. 2.

3. Insert the end of the Handle 10 illustrated in FIG. 4, into the hole 11, designated in FIG. 3 and FIG. 6, of the Coupling 7. When the Handle 10 is inserted far enough, the spring-loaded catch 12 snaps into the groove 18 of the Handle 10.

4. To lock the Handle 10 in position for painting or for cleaning the paint roller pad, swivel the Handle 10 to the desired position as illustrated in FIG. 1 or FIG. 11, and push it 10 as far as it will go into the Coupling 7. The spring-loaded catch 12 will snap into the appropriate hole 19 or 19' in the Handle 10.

5. This step required for cleaning operation only: To prepare the Drive Shaft 13 for use, clamp its end 22 into the chuck of a drill motor, and insert its free end, which has the spring-loaded catch 21 into the end 4' of the hollow shaft 4,4' of the Roller Assembly 1.

OPERATION

Roller Assembly:

The Roller Assembly 1, by means of its framework 2,2' mounted on the two disks 3,3', supports a paint roller pad; by means of its hollow shaft 4,4'; and in conjunction with the bearing in the Coupling 7, provides the capability for rotary motion. The four collars 5,5',6,6' provide the means for fixing the two disks 3,3' onto the hollow shaft 4,4'. The haxagonally-shaped inner wall 14 of the hollow shaft 4,4' provides the means for engaging the hexagonally-shaped, detachable Drive Shaft 13 to the Roller Assembly 1.

Drive Shaft:

The Drive 13, because of its hexagonal shape, and sufficient length, provides the means for connecting a source of rotary energy, such as an electric drill motor, to the Roller Assembly 1. The spring-loaded catch 21 plunges into the retaining hole 23 inside the hollow shaft 4,4'.

Coupling:

The Coupling 7, by means of its hole 16, provides the bearing support for the hollow shaft 4,4' or the Roller Assembly 1; by means of its hole 11, and inner recess 17 located in the vertical section of its "T" structure, provides for mounting the Handle 10 and locking it in either of the two positions illustrated in FIG. 1 and FIG. 11; by means of its spring-loaded catch 12, in conjunction with the structure of the Handle 10 provides for retaining the Handle 10 in the Coupling 7, and holding the Handle 10 in either of the two said locking positions.

Handle:

The Handle 10, by means of the groove 18 and two holes 19,19' in conjunction with the spring-loaded catch 12 provides for retaining the Handle 10 in either of the two said locking positions. When the moving element of the spring-loaded catch 12 is thrust into one of the holes 19 or 19' in the Handle 10, it prevents the Handle 10 from coming out of the locked position it is in. When the moving element of the spring-loaded catch 12 is thrust into the groove 18 of the Handle 10, it prevents the Handle 10 from coming out of the Coupling 7, but allows it 10 to swivel into the desired position for painting, or for cleaning the paint roller pad.

The Handle 10, by means of its overall general shape and handgrip 20, provides for manually holding the Apparatus when used for painting, and also manually holding it when used for cleaning the paint roller pad 24 in FIG. 11.

VARIATIONS

While the above description contains many specifics, these specifics are not intended to be limitations on the scope of the invention, but rather comprise an example of one embodiment thereof. Many variations are possible. For example:

1. The Drive Shaft 13 and the inner surface of the end 4' of the hollow shaft 4,4' can be any shape that allows satisfactory engagement of the two components, such as a spline, square, triangle, etc; or it can be round or oval with a notch in the Drive Shaft and a corresponding recess in the hollow shaft.

2. The locking, swiveling, retaining means for the Handle 10 could be any means that satisfies that purpose. For example:

a. The means for locking the Handle 10 could be a hole of any shape capable of preventing swiveling of the Handle when it is locked in place.

b. The means for retaining the Handle 10 in place could be a spring-loaded plunger instead of the spring-loaded catch 12 illustrated.

c. The said locking, swiveling, retaining means could be a type of cotter pin inserted through or about the shaft of the Handle 10 in any suitable manner. The cotter pin could be the type that locks in place by spring action.

3. The means for mounting the paint roller pad can be any means that satisfies that purpose. For examplet, the means could consist of two disks such as items 3 and 3' without the framework 2,2', the disks being large enough to hold the paint roller pad at its ends. The disk 3' next to the Coupling 7 can be permanently fixed to the hollow shaft 4,4' as illustrated, but the disk 3 can be secured in place by the collar 5' and a nut in place of collar 5. For this arrangement, that end of the hollow shaft 4,4' near the collar 5 would be threaded to match the nut threads.

4. The Coupling 7 can be a molded part, or partly molded with a bushing inserted in the hole 16.

5. The lubricating hole 20 can be a conventional grease fitting.

REFERENCES

Examples of the spring-loaded catches 10 and 21 mentioned in the above descriptions and the spring-loaded plunger mentioned in the section titled: VARIATIONS are listed as follows:

1. Spring-Loaded Catch, Hartwell Co., 900 S. Richfield Rd, Placentia, Calif. Part No. 132; Trade Name-NYLATCH Bullet Catch.

2. Spring-Loaded Plunger, SOUTHCO, Concordville, Pa. Part Nos. 56-10-801-10, 56-10-802-10, and 56-10-803-10.

USING THE APPARATUS

As a Paint Applicator:

To use the Apparatus to apply paint to a suitable surface, set the Handle 10 as illustrated in FIG. 1, install a paint roller pad onto the framework 2,2' of the Roller Assembly 1, and use the Apparatus in a conventional manner to apply paint to the said surface.

As a Paint Roller Pad Cleaner:

For Cleaning Water-Base Paint: To use the Apparatus to clean water-base paint from a paint roller pad, set the Handle 10 as illustrated in FIG. 11, prepare the Drive Shaft 13 for use as described in Step 5 under the heading: ASSEMBLING THE APPARATUS. Then plug the drill motor power cord into an electrical outlet and, holding the drill motor by its handle in one hand, and the Apparatus by its Handle 10 in the other hand, immerse the paint roller pad into the vessel 25 of water 26, and apply power to the drill motor. After about 10 seconds, while the paint roller is still spinning under power, withdraw it from the water. The paint roller pad will emerge from the water bath substantially cleaned. Repeat the process with a new supply of clean water if necessary.

For Cleaning Oil-Base Paint: To clean a paint roller pad used with oil-base paint, the cleaning liquid can be water with a small amount of detergent dissolved in it. The procedure includes using a plastic glove to protect the hand, and massaging a small amount of oil-base paint solvent into the surface of the paint roller pad; then proceding as with a paint roller pad used with water-base paint, as described above.

Analysis of the Cleaning Action:

Spinning a paint roller pad that is completely immersed in a liquid will cause considerable agitation of the liquid, and the friction between the paint roller pad and the liquid will have a scrubbing action on the paint roller pad. Centrifugal force will carry loosened particles away from the paint roller pad to be dispersed in the liquid. The combination of agitation, scrubbing, and centrifigal force will clean the paint roller pad.

Furthermore, when the paint roller pad is withdrawn from the liquid while still spinning, centrifugal force will continue to propel the new relatively clean liquid from the surface of the paint roller pad outward along the surface of the liquid. The surface of the swirling liquid assumes a shape, as illustrated in FIG. 10, that swells above the part of the paint roller pad that is just emerging from the liquid. The spraying liquid settles into that surface, and there is no spray of liquid into the air. The paint roller pad emerges spun to a damp-dry and fluffy state.

I claim:

1. A paint roller apparatus with inherent cleaning capability comprising a Roller Assembly, Coupling, Handle, and Drive Shaft so assembled that:

a. the Coupling joins together the Roller Assembly and Handle, with the Roller Assembly and Coupling forming a rotary bearing-type relationship whereby the mating part of the Roller Assembly constitutes a hollow or partially-hollow shaft which can rotate freely within the complementary part of the Coupling which constitutes the bushing, and b. the Handle and Coupling form a rotary bearing-type relationship whereby the mating part of the Handle constitutes a shaft which can rotate within the mating part of the Coupling which constitutes the bushing, said rotation of the Handle being limited by two stops which comprise a means for locking the Handle in two positions approximately one hundred and eighty degrees apart on the axis of rotation, said stops comprising complementary structures on the said shaft and bushing located within the said bearing structure, and said stops being located so as to lock the Handle in two positions, one position suitable for using the paint apparatus for painting, the other position suitable for using the apparatus for cleaning the paint roller pad, said cleaning operation being partly implemented by:

c. the Drive Shaft, which coaxially and detachably connects to the end the hollow shaft on the Roller Assembly that constitutes the part of the rotary bearing between the Roller Assembly and the Coupling, as mentioned in part a of this claim.

2. The paint apparatus of claim 1 wherein the Roller Assembly comprises an elongated cylindrical framework of a size capable of supporting a standard paint roller pad, mounted on a hollow or partially-hollow internally-non-circular shaft that is coaxial with the framework, approximately coterminous with the framework on one end, extending from the opposite end of the framework an amount sufficient to pass completely through the Coupling to form a bearing-type relationship with the Coupling, is approximately coterminous with the Coupling at the boundary of the Coupling that is located opposite the Roller Assembly framework, and can coaxially engage the Drive Shaft which can be inserted into the non-circular hollow end of the Roller Assembly shaft, the Drive Shaft having approximately the same cross-sectional shape and dimensions as the hollow end of the Roller Assembly shaft.

3. The paint apparatus of claim 1 wherein the Coupling comprises a structure formed in an approximate T shape with the cap of the T being hollow forming a tunnel running the length of the cap, and the shank of the T also being hollow forming a second tunnel, said tunnel in the cap of the T mating with the extended hollow shaft of the Roller Assembly to form a rotary bearing-type relationship as described in claim 2, and said tunnel in the shank of the T mating with the end of the Handle opposite the handle grip, also forming a rotary bearing-type relationship.

4. The paint apparatus of claim 1 wherein the Handle comprises a shaft with a handle grip on one end, said shaft having two bends located at appropriate positions on the shaft so that the handle grip extends from a point that is approximately adjacent to the center of the long dimension of the Roller Assembly framework in a direction that is an approximate right angle to the long dimension of the Roller Assembly, and the opposite end of the shaft, as referred to in claim 3, can be inserted into the shank of the T Coupling, forming the bearing type relationship as described in claims 1*a* and 3.

5. The paint apparatus of claim 1 wherein the Drive Shaft comprises a straight non-circular shaft of sufficient length and cross sectional dimensions such that one end of the Drive Shaft can be inserted into the end of the non-circular hollow shaft part of the Roller Assembly that extends from the Roller Assembly Framework through the Coupling, and the other end of the Drive Shaft can be inserted into the chuck of a common drill motor, such that said drill motor can apply rotary power directly to the axis of the Roller Assembly, the axis of the drill motor being aligned with the axis of the the Roller Assembly.

* * * * *